United States Patent [19]

Mueller et al.

[11] Patent Number: 4,518,350

[45] Date of Patent: May 21, 1985

[54] APPARATUS AND METHOD FOR CALCINING SAND

[75] Inventors: Edward E. Mueller, Tonka Bay; Paul L. Jensen, Minneapolis, both of Minn.

[73] Assignee: Whirl-Air-Flow Corporation, Minneapolis, Minn.

[21] Appl. No.: 594,557

[22] Filed: Mar. 29, 1984

[51] Int. Cl.[3] ..... F27B 14/00; F27B 9/14; F27D 1/16

[52] U.S. Cl. ..... 432/13; 209/11; 432/3; 432/134

[58] Field of Search ..... 432/3, 13, 105, 118, 432/134; 209/11

[56] References Cited

U.S. PATENT DOCUMENTS

| | | | |
|---|---|---|---|
| 1,892,271 | 12/1932 | Hart | 432/13 |
| 1,972,868 | 9/1934 | Case | 432/134 |
| 4,050,635 | 9/1977 | Mueller et al. | 241/24 |
| 4,392,949 | 7/1983 | Kruyer | 209/11 |

OTHER PUBLICATIONS

Brochure about Sand Source thermal reclamation system by Combustion Engineering Inc., (undated).

Portion of a brochure about a pendulum calciner by Bickley Furnaces Incorporated, May, 1982.

Drawing dated 11/11/80 about Coreco Indirect Fired Kiln from College Research Corporation.

Portion of a diagram of old multiple hearth roasting, (undated).

*Primary Examiner*—John J. Camby

*Attorney, Agent, or Firm*—Merchant, Gould, Smith, Edell, Welter & Schmidt

[57] ABSTRACT

A sand calciner system (10) includes a refractory lined drum (12) mounted for oscillation about its longitudinal axis (14). An arrangement of plows (76) are provided along the bottom inside of the drum (12) for mixing the sand received through an inlet (54) and advancing it toward a discharge outlet (56) responsive to oscillation of the drum over a predetermined arc about the axis (14). The plows (76) are arranged in staggered rows with each plow having a transverse front surface facing the inlet (54), an inclined top surface, and an angled back surface facing the outlet (56). An aerator pipe (78) is provided in conjunction with the plows (76) to fluidize the sand and thereby effect more thorough mixing and exposure to burners (58) positioned along the upper side of the drum (12) for complete calcining. A tempering section (16) and screening section (18) are preferably connected to the discharge end of the drum (12) to precool the calcined sand and then classify it for further handling and reuse in foundry cores and molds or the like.

20 Claims, 9 Drawing Figures

FIG. 5A
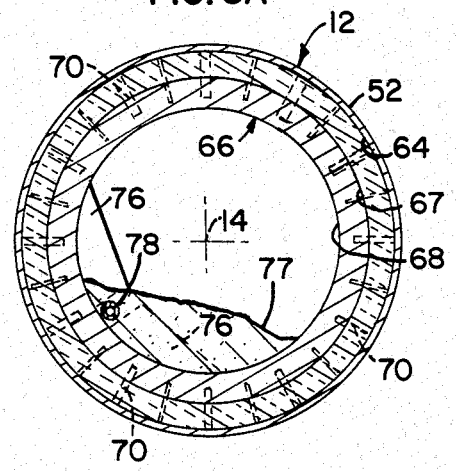
FIG. 5B
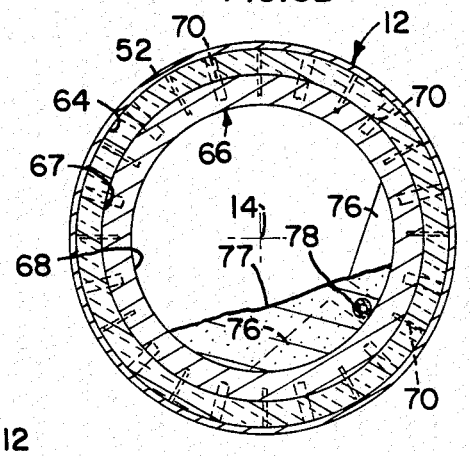
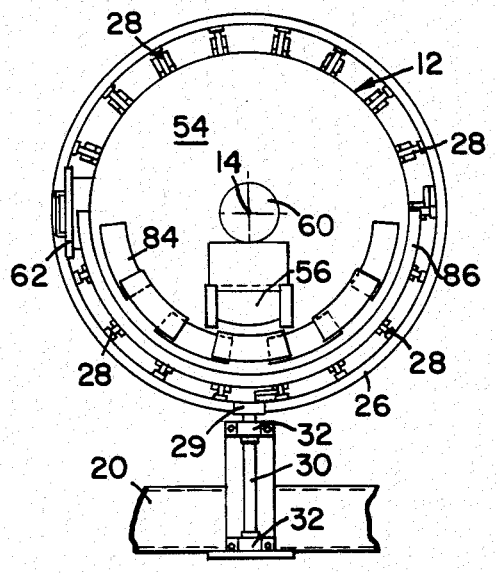
FIG. 6

FIG. 7
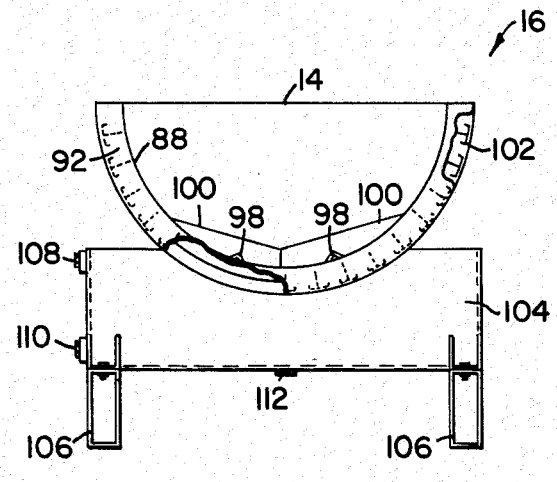
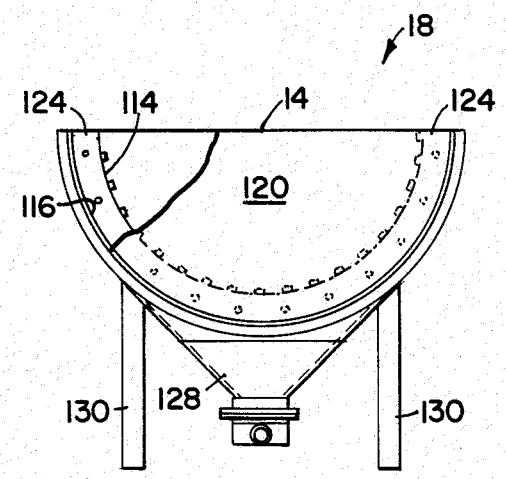
FIG. 8

APPARATUS AND METHOD FOR CALCINING SAND

TECHNICAL FIELD

The present invention relates generally to sand reclamation. More particularly, this invention involves an improved apparatus and method for calcining sand on a continuous basis by means of a direct fuel fired oscillating drum adapted to provide better temperature control and mixing during thermal reclamation of the sand.

BACKGROUND ART

Traditionally, sand molds have been used for casting in the foundry and ceramics industries. The sand molds are typically a mixture of sand and binders (or sand otherwise chemically treated) which is tailored to form a mold and core for the particular item to be cast. Once the item has been cast, the mold and core must be broken to remove the casting.

Instead of discarding the broken molds, it has been common practice in the industry to recycle the molds to reclaim the sand for reuse in subsequent molds. This generally includes both physical and thermal reclamation. First, the lumps comprising the broken molds must be reduced to return the sand to usable granular form and to separate any tramp metal or oversized material from the reclaimed sand. It will be appreciated that broken sand molds are extremely hard and thus difficult to break up such that special equipment has been developed for this purpose. For example, U.S. Pat. No. 4,050,635 to Whirl-Air-Flow Corporation, the assignee of the present invention, shows a sand reclamation apparatus which is well suited for this purpose.

After physical reclamation, the reclaimed granular sand must then be treated to remove residual coatings for reuse as new sand supplement. This additional treatment is usually performed by heating the sand to an elevated temperature. Such thermal reconditioning usually takes place in a calciner which is, in effect, a special kiln in which all hydrocarbons and any remaining resins or binders are cleaned from the granular sand. Thermal treatment also stabilizes the sand expansion characteristics, a very desireable feature.

Various types of sand calciners or thermal reclamation systems have been available heretofore, however the devices of the prior art have tended to be bulky, slow, inefficient, overly expensive, or otherwise unsatisfactory for one reason or another. For example, the old Nickles-Hershoff machine utilized a multiple hearth tower which was fired tangentially and which incorporated a center shaft with plows for plowing the sand back and forth between levels of fire brick. This machine, however, is expensive and difficult to maintain, and difficult to control during operation. The Coreco indirect fired kiln from College Research Corporation of Germantown, Wis., incorporates an inner tube which is heated by burners extending through a surrounding refractory lining such that there is no direct flame impingement on the sand to assure thorough calcining and complete removal of the binders. Finally, the SAND SOURCE thermal reclamation system from Combustion Engineering, Inc. of Pittsburgh, Pa., incorporates a rotary drum with a burner extending into one end which does not permit properly controlled temperature distribution within the drum.

There is thus a need for a new and improved method and apparatus for calcining sand in which fluidized sand is indexed through a rocking or oscillating drum in a manner which causes thorough mixing and exposure of the sand to multiple burners located along the top side of the drum such that more effective calcination is achieved.

SUMMARY OF INVENTION

The present invention comprises a method and apparatus for calcining sand which overcomes the foregoing and other difficulties associated with the prior art. In accordance with the invention, there is provided an elongate, refractory lined drum defining a generally cylindrical chamber. The drum is mounted for rocking motion or oscillation, instead of full rotation, about its longitudinal axis. The drum includes an inlet end for receiving sand, an outlet end for discharging the sand after calcination, and burners spaced along the upper side of the drum. Index structure is provided along the lower inside of the drum for advancing the sand and for effecting thorough mixing of the sand responsive to drum oscillation to achieve complete calcination. In the preferred embodiment, the indexing structure comprises two longitudinal rows of staggered plows having inclined tops and angled faces adapted both to advance and to mix the sand as the drum is oscillated over a predetermined arc. An aerator tube preferably extends along the bottom of the drum between the rows of plows to fluidize the sand thereby facilitating better mixing, and adding secondary combustion air to the interior of the drum for complete calcination. A tempering section is preferably secured to the outlet end of the drum for receiving and initially pre-cooling the hot calcined sand. The tempering section includes a curved wall, cooled by partial immersion in a water bath, over which the sand is passed. In the preferred embodiment, a screening section is secured to the tempering section for movement with the drum. The screening section includes inner and outer curved screens for separating out any agglomerates carried into or formed during passage through the drum. The screening section includes a stationary hopper for receiving the calcined, pre-cooled sand.

BRIEF DESCRIPTION OF DRAWINGS

A better understanding of the invention can be had by reference to the following Detailed Description in conjunction with the accompanying Drawings, wherein:

FIGS. 5A and 5B are sectional views taken along lines 5—5 of FIG. 1 in the direction of the arrows illustrating oscillation of the drum;

FIG. 6 is a vertical section view taken along lines 6—6 of FIG. 1 in the direction of the arrows showing the outlet of the drum;

FIG. 7 is a sectional view taken along lines 7—7 of FIG. 1 in the direction of the arrows showing details of the tempering section; and FIG. 8 is a sectional view taken along lines 8—8 of FIG. 1 in the direction of the arrows showing details of the screening section.

DETAILED DESCRIPTION

Figure 1:
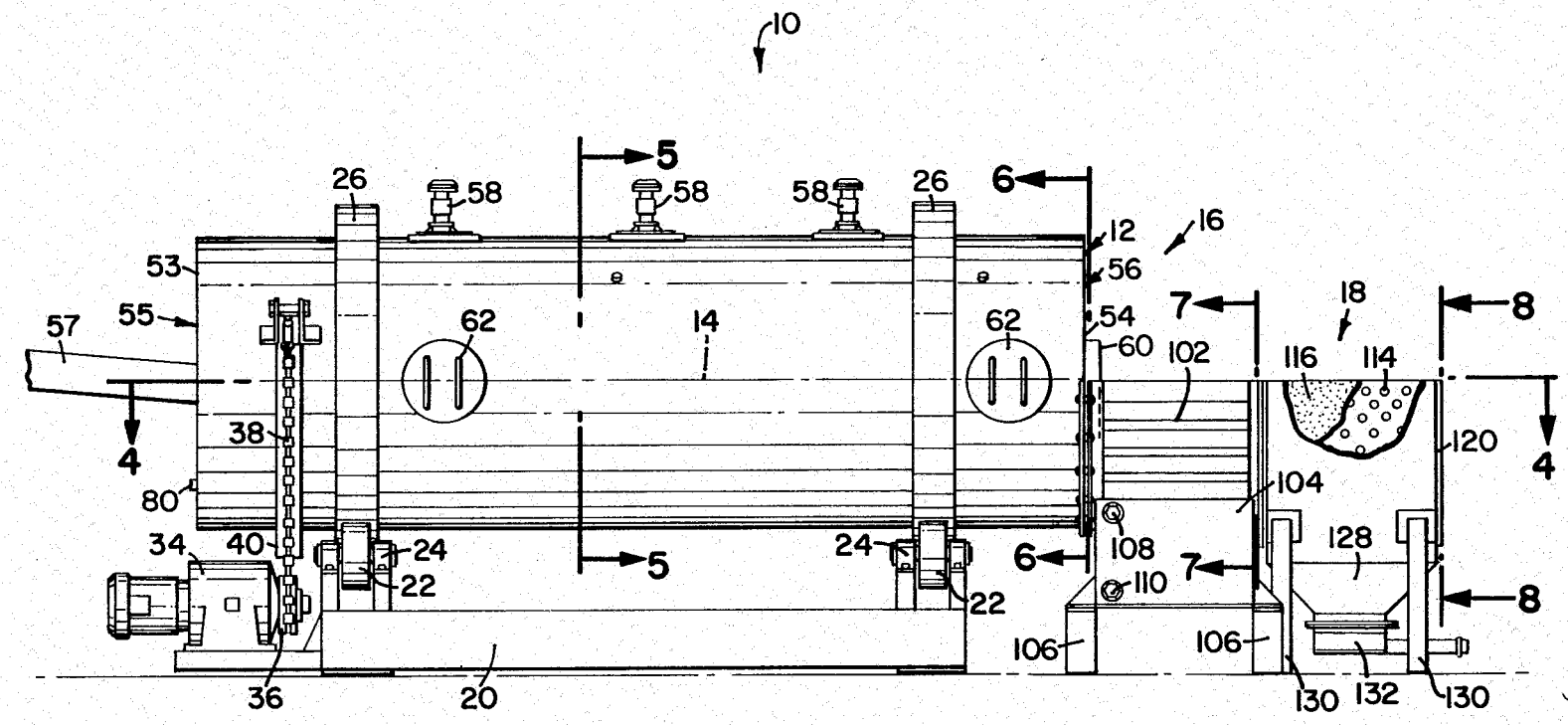
FIG. 1 is a side view of the sand calciner system incorporating the invention.
Figure 3:
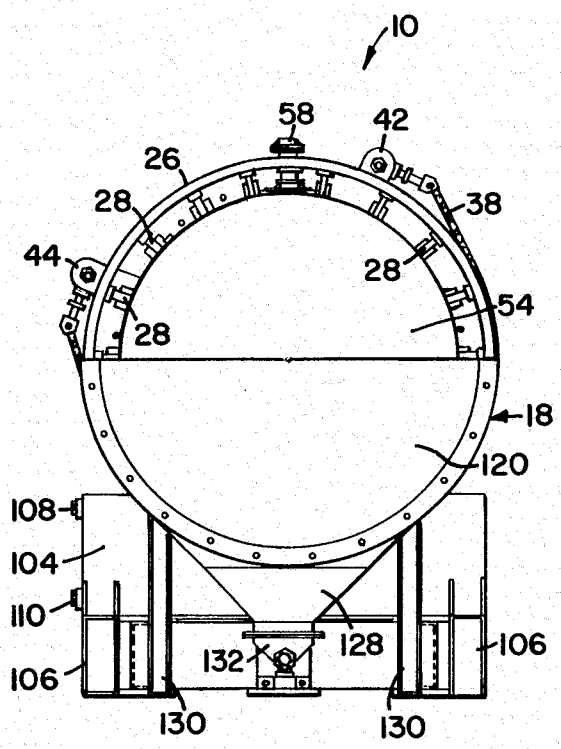
FIG. 3 is a back end view of the sand calciner system shown in FIG. 1.

Referring now to the Drawings, wherein like reference numerals designate like or corresponding elements throughout the views, and particularly referring to FIG. 1, there is shown the sand calciner system 10 of the invention. The system 10 includes a generally cylindrical drum 12 supported for oscillation about its longitudinal axis 14, a tempering section 16 adjacent the outlet end of the drum, and a screening section 18 adjacent the tempering section. As will be explained more fully hereinafter, the sand calciner system 10 is particularly adapted for calcining sand on a continuous basis with improved temperature control and mixing to effect thorough thermal reclamation of sand for use or reuse in foundry molds and cores.

Figure 2:
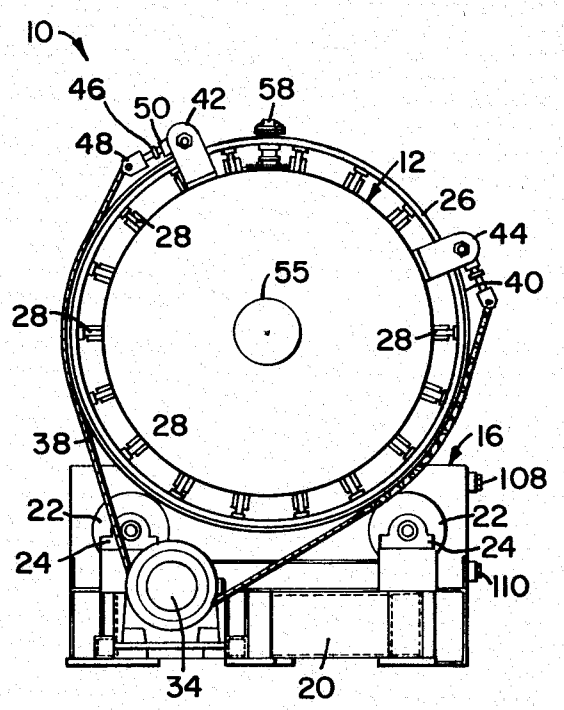
FIG. 2 is a front end view of the sand calciner system shown in FIG. 1.

The calciner drum 12 is supported by a frame 20 which is constructed of suitable structural members, such as steel beams, welded or otherwise secured to form a rigid structure. The frame 20 is generally rectangular in shape. Provided at each corner of the frame 20 is a wheel 22 which is mounted for rotation on a shaft journaled between a pair of pillow bearings 24. The support wheels 22 are arranged in two lateral pairs, which engage an associated "tire" or external ring 26 on the drum 12. Two rings 26 are provided on the drum 12. Each ring 26, which is preferably of seamless construction, is secured to the drum 12 by welded shims 28 as best seen in FIG. 2, or other suitable means, so that the drum and rings are both concentric with the longitudinal axis 14. As illustrated, the axis 14 is substantially horizontal, however, the frame 20 and support rollers 22 can be constructed so that the axis may be angled slightly downward in the direction of the tempering section 16 and screening section 18 in order to facilitate and/or increase the flow rate of sand through the calciner system 10. It will be understood, however, that the system 10 will operate satisfactorily with the axis 14 oriented substantially horizontal.

Referring momentarily to FIG. 6, the calciner drum 12 is longitudinally constrained on the frame 20 by means of a pair of thrust rollers 29, only one of which is shown. The thrust rollers 29 engage opposite circular edges of the external ring 26 on the drum 12 to hold the drum on the support rollers 22 and prevent it from slipping off, particularly if the axis 14 should be slightly declined. Each thrust roller 29 is secured to the end of a shaft 30 which is supported for rotation between a pair of bearings 32 secured to an upright on a cross member of the frame 20.

Referring again to FIGS. 1 and 2, the calciner drum 12 is driven by a motor 34 having an output shaft with a drive sprocket 36 thereon to which a chain 38 is secured. The motor 34 is preferably of the reversible type which includes a brake. For example, a twenty horsepower model R130DP Sew Furo-drive gear motor having a B3 electric brake can be utilized for the motor 34. The chain 38 extends from the drive sprocket 36 around a collar 40 secured to the drum 12 for connection with two pairs of circumferentially spaced lugs 42 and 44 which are also secured to the drum. The collar 40 extends only partially about the drum 12 between lugs 42 and 44. The opposite ends of the chain 38 are each connected to the respective lugs 42 and 44 by an adjustable tensioning assembly comprising a rod 46 with oppositely threaded ends secured between a block 48 attached to the end of the chain and a T-bar 50 pivoted between the associated pair of lugs. It will thus be appreciated that the calciner drum 12 is supported by rings 26 on rollers 22 for oscillation about the axis 14 responsive to reversible drive motor 34.

Referring now to FIGS. 5 and 6 in conjunction with FIG. 1, further constructional details of the calciner drum 12 can be seen. The drum 12 comprises a cylindrical shell 52 closed at opposite ends by circular end plates 53 and 54. A material inlet 55 is located in end plate 53, and a material outlet 56 is located in end plate 54. The shell 52 and end plates 53 and 54 can be formed from half inch steel plate or other suitable material. The drum shell 52 can be about 29 feet long and 5 feet in outside diameter, depending of course on the capacity desired. The sand calciner system 10 is typically charged with sand by means of a screw conveyor 57 as shown in FIG. 1, extending through the inlet 55 from a surge hopper or the like.

A plurality of gas burners 58 are provided at longitudinally spaced intervals along the upper side of the drum 12 and a single exhaust flue 60 is located at discharge end plate 54. As illustrated, three gas burners 58 are provided, however, this particular number of burners are not critical to practice of the invention and any suitable number of gas burners can be utilized. A plurality of gas burners 58 is preferable because they can be individually controlled and this facilitates better temperature modulation within the drum 12 to obtain a minimum time to reach the calcining temperature without overheating that may cause partial fusing of binders. Provision of gas burners 58 positioned at longitudinal intervals along the top side of the drum comprises an important feature of the invention because this allows the use of direct flames without overheating. A pair of removable plugs 62 are preferably provided along the lateral side of drum 12 for access to the interior of the drum.

Figure 4:
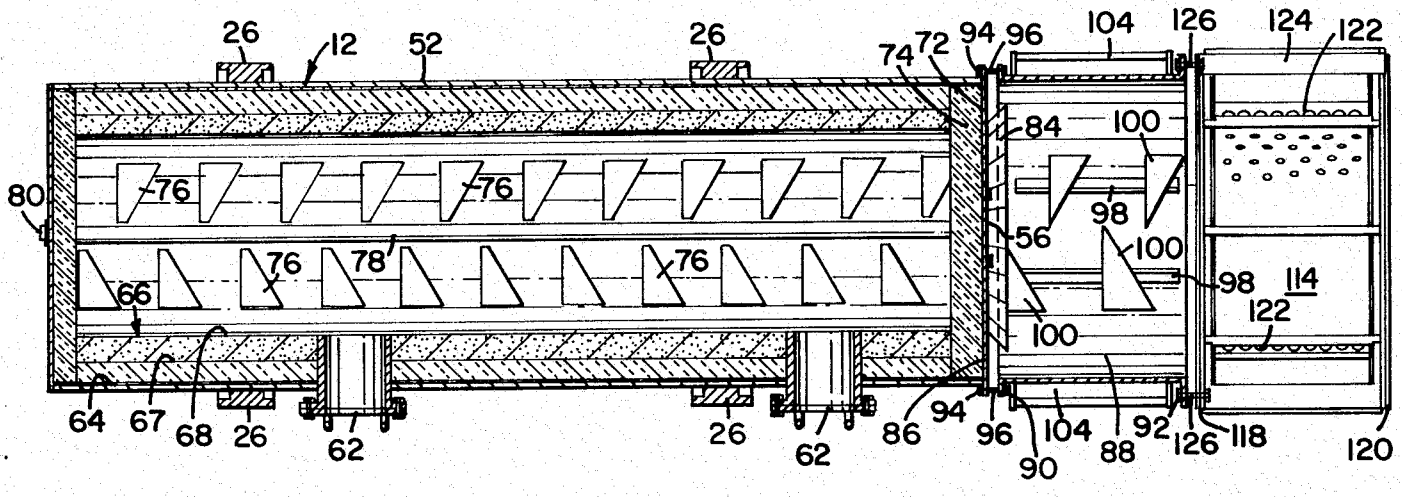
FIG. 4 is a partial horizontal sectional view taken along lines 4—4 of FIG. 1 in the direction of the arrows.

Referring to FIGS. 4 and 5, the interior of drum 12 is lined with refractory material to define a hearth, and is also adapted to effect advancement and mixing of the sand as the drum oscillates over a predetermined arc centered on axis 14. In particular, the interior side of the shell 52 is preferably covered with layers of insulating paper or other suitable insulation 64, which in turn are covered by a liner 66 of refractory material. In accordance with the preferred construction, the liner 66 comprises an outside layer 67 of light weight refractory material which in turn is covered by an inner layer 68 of denser refractory material having better wear characteristics. Layers 67 and 68 can be formed of castable material or brick shapes. As illustrated, the liner 66 is formed by casting suitable refractory material in place over anchors 70 as are best seen in FIGS. 5A and 5B. Similarly, layers of insulation 72 covered by a liner 74 of refractory material are provided on the inside of the end plates 53 and 54, as is best seen in FIG. 4.

A plurality of plows 76 are provided along the lower inside surface of the calciner drum 12 for advancing the sand towards the outlet 56 as the drum oscillates about axis 14, and for mixing and rolling the sand during advancement for maximum exposure to the flames from burners 58, radiation from the refractory, and conduction from the hearth, in order to achieve thorough calcination. The plows 76 are oriented in two staggered longitudinal rows, as is best seen in FIG. 4, with each plow being of generally triangular shape. The plows 76 can be of precast refractory material, of cast alloy steel, or of fabricated stainless steel plate. For example, the plows 76 can be about eight inches deep near the middle of the drum 12, with the top surfaces being inclined as shown so that the plows are effective over the oscillation arc of the drum. The upper surfaces of the plows 76 can be inclined at about 28 degrees off horizontal, for example.

FIGS. 5A and 5B show the drum 12 at its opposite extremes of oscillation. The drum 12 oscillates over a predetermined arc centered on axis 14, which may be about 110 degrees or 55 degrees either way off vertical. Line 77 represents the typical level of sand in the drum 12 during operation of system 10. As the drum 12 oscillates between these extremes, the sand rolls back and forth between the rows of plows 76, thus mixing as well as advancing the sand toward the outlet 56. Sand is primarily silica, which is a good insulator, and it will be appreciated that the vigorous mixing effected by the plows 76 as the drum 12 oscillates assures thorough heating of the sand and maximum exposure to the burners 58. Sand calcining within the drum 12 is therefore accomplished by direct flames from burners 58, radiation, and counduction from the refractory liners 64 and 74 defining the hearth within drum 12. The provision of staggered plows 76 with inclined top surfaces inside the oscillating drum 12 comprises a significant feature of the present invention.

In accordance with the preferred embodiment, the calciner drum 12 further includes a longitudinal aerator pipe 78 extending between the rows of plows 76. The outer end of the aerator pipe 78 extends through the inlet end of drum 12 and is connected by a flexible fitting 80 to a source of pressurized air (not shown). As drum 12 oscillates, air is injected underneath the sand to effect at least partial fluidization. This aids movement of the sand toward the discharge outlet 56 as well as effective mixing of the sand. In addition, it will be appreciated that injection of air into the sand adds secondary oxygen to the combustion chamber defined within the drum 12, in addition to that inspirated through drum inlet 55, and helps to carry fumes and hydrocarbons upward toward the burners 58 for complete incineration. Air flow through the aerator pipe 78 can be continuous or pulsed. The provision of an aerator pipe 78 in the calciner drum 12 comprises another significant feature of the invention.

FIG. 6 shows the outlet end of the drum 12 including the exhaust flue 60. A slideable door 82 is provided over the material discharge outlet 56 for controlling the flow rate of hot calcined sand out from the drum 12. The slidable door 82 can be of any suitable construction. As shown, for example, the door 82 consists of a plate slidable in a generally vertical direction between a pair of rails through which the plate can be secured in any desired position by means of pins on chains, so that the size of outlet 56 is adjustable in accordance with the desired throughput of sand. A generally semi-circular spout or lip 84 is also provided beneath the discharge outlet 56 for directing discharge of the sand as drum 12 oscillates. The lip 84 can be formed from overlapping plates as shown, or from a continuous length of material. A semi-circular flange 86 is also provided on the outlet end of the drum 12 for connection with an adjacent section of system 10.

Referring to FIGS. 1, 4 and 7, in accordance with the preferred embodiment of the sand calciner system 10, a tempering section 16 is provided adjacent to the discharge end of the drum 12 for receiving the hot calcined sand and tempering the temperature thereof. The tempering section 16 comprises an upper receiver portion moveable with the drum 12, and a lower fixed portion. The tempering section 16 includes a generally semi-cylindrical bottom wall 88 which on one side extends beneath lip 84 and is thus positioned to receive sand from the outlet 56. The bottom wall 88 is of continuous construction without perforations. The bottom wall 88 is secured between a pair of semi-annular end plates 90 and 92. As is best seen in FIG. 4, the end plate 90 of the tempering section 16 is secured by bolts 94 and tubular spacers 96 to the flange 86 on the discharge end of drum 12. Part of the tempering section 16 is thus secured directly to the discharge end of drum 12 for oscillation therewith. A pair of longitudinal ribs 98 together with two rows of staggered plows 100 are provided on the bottom wall 88. Plows 100 are similar in construction and function to plows 76 inside drum 12, except that their purpose is to advance the hot sand and maximize contact with the air and cold bottom wall 88 for cooling. The ribs 98, which can be constructed from sections of angle iron, serve to induce even more rolling of the sand back and forth on wall 88 between the plows 100 as the receiver portion of the tempering section 16 oscillates with drum 12.

Longitudinal T-shaped members 102 are secured to the underside of the bottom wall 88, which in turn are partially immersed in water held in an underlying lower portion comprising a stationary tank 104 supported on legs 106. The tank 104 includes an inlet 108, outlet 110, and bottom drain plug 112. As the drum 12 oscillates and the upper portion of the tempering section 16 oscillates with it, the underside of the bottom wall 88 is immersed in the water or other coolant in tank 104 to cool the bottom wall 88 and the sand thereon. It will be noted that the T-shaped longitudinal member 102 on the underside of the bottom wall 88 are slightly circumferentially spaced apart in order to define open channels for receiving and partially retaining a portion of the coolant therein as the bottom wall 88 oscillates relative to the cooling tank 104. The level of coolant in tank 104 can be maintained by a conventional float control (not shown).

After precooling in the tempering section 16, the calcined precooled sand is then preferably directed into the screening section 18, the constructional details of which are best seen in FIGS. 4 and 8. The screening section 18 also includes an upper receiver portion movable with the drum 12, and a fixed lower portion. The generally U-shaped upper portion includes a semi-cylindrical perforated inner plate 114 and a generally semi-cylindrical outer plate or screen 116 secured between a pair of end plates 118 and 120. Perforated intermediate stringers 122 and topside plates 124 are also secured between the inner perforated plate 114 and outer screen 116. The perforations in the inner plate 114 are preferably larger than the openings in the outer screen 116. For example, the inner plate 114 can be of ten gauge material with quarter inch perforations on staggered centers, while the outer screen 116 can comprise 16 mesh wire. The openings in the longitudinal stringers 122 can be about 2½ inches in diameter or otherwise large enough to freely pass the sand which passes through the inner perforated plate 114 while providing some scrubbing of the granules which will not pass through the outer screen 116. The semi-annular end plate 118 of the screening section 18 is secured by bolts 126 to the adjacent end plate 92 of the tempering section 16 so that the upper portions of sections are connected in series for oscillation with the drum 12.

The precooled, calcined sand is thus classified by the screening section 18 into oversized material which remains on top of the perforated inner plate 114, intermediate sized material which passes through the inner plate but will not pass through the outer screen 116 without further reduction, and finished material which passes through both the perforated inner plate as well as the outer screen for collection in a stationary underlying hopper 128 supported by legs 130. The lower portion of screening section 18 thus includes hopper 128 and legs 130. A vacuum outlet 132, or a discharge provision for a conveyor belt, screw conveyor or other method, is secured to the hopper 128 for conveying the calcined, precooled and screened sand on to another point, such as a sand cooler, for final cooling before reuse in the foundry molds.

As illustrated, the end plate 120 of the screening section 118 is of semi-circular shape whereby the oversized material is retained therein. If desired, however, the end plate 120 can be provided with a discharge outlet and spout similar to those provided in the discharge end of drum 12, so that the oversized material can be conveniently collected in a tote for further reduction.

The sand calciner system 10 operates as follows. Burners 58 are energized such that the internal temperature of the drum 12 is between about 1200° and 1800° F. The motor 34 is also energized to oscillate the drum 12 at the desired rate back and forth about the axis 14 over the desired arc for the desired flowrate and dwell time of sand in the drum. The sand to be calcined is fed into the drum 12 through inlet 54. The sand can comprise "green" or "no bake" sand, or a mixture thereof. As the drum 12 oscillates, the sand moves back and forth between the rows of plows 76 which thoroughly mix the sand and move it towards the discharge outlet 56. As the sand is thus thoroughly mixed, it is exposed to the flames from burners 58 and otherwise thoroughly heated by the hearth defined by the refractory linings 68 and 74. Any resins or other chemicals on the granules of sand are thereby driven off and incinerated to effect calcining. Air is preferably simultaneously injected into the sand through the aerator pipe 78 to fluidize the sand and thereby further promote thorough mixing action, advancement towards the discharge outlet 56, and complete incineration of the resins. The temperature of the sand upon reaching the discharge outlet 56 is determined by the internal temperature of the furnace, but is normally well over 1,000° F.

Following calcining in the calciner drum 12, the sand is then discharged into the tempering section 16 for precooling. The hot calcined sand is discharged from the outlet 56 onto the cooling plate bottom wall 88 which is mounted for oscillation with the drum 12. The hot calcined sand is thus mixed and advanced on the bottom wall 88 by the rails 98 and plows 100, while the underside of the plate is immersed in the cooling tank 104. Precooling of the hot calcined sand is thus accomplished by mixing and direct contact with the cool bottom wall 88. The temperature of the calcined sand at the discharge end of the tempering section 16 is usually about 500° to 800° F.

Following precooling in the tempering section 16, the precooled calcined sand is then discharged onto the screening section 18 for classification. The perforated inner plate 114 and outer screen 116 of the screening section 118 are secured through the tempering section 116 to the drum 12 for oscillation therewith. Precooled calcined sand deposited onto the perforated inner plate 114 is thus rolled back and forth across the plate to effect classification. Oversized material which will not pass through the perforated inner plate 114 remains on top for collection and further reduction. Intermediate sized material which will pass through the perforated inner plate 114 but not the outer screen 116, remains between the plate and screen and floats back and forth between the stringers 122 until it can pass through the outer screen. After passage through the perforated inner plate 114 and outer screen 116, the finished material is removed from the hopper 128 for reuse. Some additional cooling takes place during classification in the screening section 18.

If desired, direct water spray cooling can be added to the tempering section 16. The amount of water sprayed would be controlled by a sensing temperature controller placed in the discharge hopper 128.

From the foregoing, it will thus be apparent that the present invention comprises an improved apparatus and method for calcining sand having numerous advantages over the prior art. One significant advantage involves the fact that either green or no-bake sand, or a combination thereof, can be thoroughly calcined on a continuous basis. Calcining occurs in an oscillating drum incorporating staggered plows which, together with oscillation of the drum, effect thorough mixing of the sand for maximum exposure to the burners and hearth, resulting in better temperature distribution through the sand and thus complete removal of the chemical binders, resins etc.

This process is complemented by the use of an aerator pipe. After calcining, the sand is precooled and then classified to facilitate further handling and reuse as new sand. Other advantages will be evident to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, equivalents, modifications and/or rearrangements of elements falling within the scope of the invention as defined by the following claims.

What is claimed is:

1. Sand calciner apparatus, comprising:

an elongate drum having a longitudinal axis, a generally cylindrical side, and opposite generally circular closed ends;

means defining a material inlet in one end of said drum;

means defining a material outlet in the other end of said drum;

an internal liner of refractory material on the side and ends of said drum;

means for supporting said drum for at least partial rotation about its longitudinal axis;

means for effecting oscillation of said drum over a predetermined arc about its longitudinal axis;

a plurality of burners located at longitudinally spaced intervals in the side of said drum for heating the interior of the drum sufficiently to effect calcining of sand;

means defining an exhaust flue in the said other end of said drum;

a plurality of plows located at longitudinally spaced apart intervals on said refractory liner and between the ends of said drum, said plows being arranged in staggered rows with each plow having a generally transverse front surface facing the material inlet, an inclined top surface, and an angled back surface facing the material outlet, for mixing the sand for maximum exposure to said burners while advancing the sand toward the material outlet responsive to oscillation of said drum; and an aerator pipe associated with said plows for injecting air into the sand to facilitate mixing and advancing thereof, and for adding combustion air to facilitate thorough calcination of sand in said drum.

2. The sand calciner apparatus of claim 1, wherein said liner of refractory material comprises:

an outside layer of refractory material covering the side and ends of said drum;

a first layer of insulation disposed between said outside layer of refractory material and said drum;

an inside layer of relatively denser refractory material covering at least the portion of said outside layer covering the side of said drum; and, a second layer of insulation disposed between said inside and outside layers of refractory material.

3. The sand calciner apparatus of claim 1, wherein said means for supporting said drum for at least partial rotation about its longitudinal axis comprises:

a frame;

a pair of external rings secured in longitudinally spaced apart relationship about said drum;

a pair of wheels associated with each of said rings, said wheels being mounted for rotation on said frame for engagement with the associated ring on said drum; and, means for longitudinally constraining said drum against disengagement of said wheels and rings.

4. The sand calciner apparatus of claim 1, wherein said means for effecting oscillation of said drum comprises:

a reversible drive motor;

a drive sprocket driven by said drive motor;

a chain interconnecting said drive sprocket and said drum, said chain extending partially about said drum and having opposite ends secured to the drum in circumferentially spaced apart relationship;

a collar secured to said drum for supporting said chain in predetermined radially spaced apart relationship as said drum oscillates; and, means defining a tension adjustment assembly connected between at least one end of said chain and said drum.

5. The sand calciner apparatus of claim 1, further including:

a slidable door mounted for adjustable positioning over the material outlet for controlling discharge of calcined sand from the drum.

6. The sand calciner apparatus of claim 1, further including:

means defining a tempering section adjacent the said other end of said drum for precooling the hot calcined sand, said tempering section including an arcuate bottom wall connected to said drum beneath the material outlet for oscillation therewith and for receiving the sand, and an underlying stationary tank of coolant for cooling the bottom wall by partial immersion.

7. The sand calciner apparatus according to claim 6, further including:

means defining a screening section located adjacent to said tempering section for classifying the precooled calcined sand, said screening section including inner and outer arcuate perforated walls secured to the bottom wall of said tempering section for oscillation with the drum, and an underlying hopper for receiving the calcined, precooled and classified sand.

8. Apparatus for calcining sand, which comprises:

an elongate, refractory-lined drum having a longitudinal axis, a generally cylindrical side, and opposite generally circular closed ends;

means defining a material inlet in one end of said drums;

means defining a material outlet in the other end of said drum;

means for supporting said drum for at least partial rotation about its longitudinal axis;

means for effecting oscillation of said drum over a predetermined arc about its longitudinal axis;

a plurality of burners located at longitudinally spaced intervals in the side of said drum;

means defining an exhaust flue in the said other end of said drum; indexing structure located inside said drum opposite said burners for mixing the sand for maximum exposure to said burners to effect calcination, and for advancing the sand from the inlet to the outlet responsive to oscillation of said drum;

means for receiving and precooling the calcined sand discharged from the outlet of said drum; and means for receiving the calcined, precooled sand and for classifying it into sand of a predetermined granular size for further use.

9. The apparatus of claim 8, wherein said means for supporting said drum for at least partial rotation about its longitudinal axis comprises:

a frame;

a pair of external rings secured in longitudinally spaced apart relationship about said drum;

a pair of wheels associated with each of said rings, said wheels being mounted for rotation on said frame for engagement with the associated ring on said drum; and, means for longitudinally constraining said drum against disengagement of said wheels and rings.

10. The apparatus of claim 8, wherein said means for effecting oscillation of said drum comprises:

a reversible drive motor;

a drive sprocket driven by said drive motor;

a chain interconnecting said drive sprocket and said drum, said chain extending partially about said drum and having opposite ends secured to the drum in circumferentially spaced apart relationship;

a collar secured to said drum for supporting said chain in predetermined radially spaced apart relationship as said drum oscillates; and, means defining a tension adjustment assembly connected between at least one end of said chain and said drum.

11. The apparatus of claim 8, wherein said indexing structure comprises:

a plurality of plows located at longitudinally spaced apart intervals between the ends of said drum, said plows being arranged in two staggered rows with each plow having a generally transverse front surface facing the material inlet, an inclined top surface, and an angled back surface facing the material outlet.

12. The apparatus of claim 8, wherein said receiving and precooling means comprises:

an arcuate bottom wall secured to said drum beneath the material outlet for oscillation therewith, said bottom wall having upper and lower surfaces;

structure secured to the upper surface of said arcuate bottom wall for mixing and advancing the calcined sand responsive to oscillation of said drum;

a tank of liquid coolant underlying said arcuate bottom wall for effecting cooling thereof by at least partial immersion in the coolant; and, a plurality of longitudinal channel members secured in circumferentially spaced apart relationship to the lower surface of said bottom wall for lifting and retaining portions of the liquid coolant upon oscillation of said bottom wall to enhance better cooling.

13. The apparatus of claim 8, wherein said receiving and classifying means comprises:

inner and outer arcuate perforated plates connected through said receiving and precooling means for oscillation with said drum;

said inner perforated plate having relatively larger perforations therein than said outer perforated plate; and, a hopper underlying said perforated plates for receiving the classified sand.

14. The apparatus of claim 8, further including:

an aerator pipe associated with said indexing structure for injecting air into the sand to facilitate mixing and advancing thereof, and for adding combustion air to said drum to facilitate thorough calcination by said burners.

15. A system for calcining, precooling and classifying sand, which comprises:

an elongate, refractory-lined drum having a longitudinal axis, a generally cylindrical side, and generally circular opposite closed ends;

means defining a material inlet in one end of said drum;

means defining a material outlet in the other end of said drum;

means for supporting said drum for at least partial rotation about its longitudinal axis;

means for effecting oscillation of said drum over a predetermined arc about its longitudinal axis;

a plurality of burners located at longitudinally spaced intervals along the side of said drum;

means defining an exhaust flue in the said other end of said drum;

a plurality of plows located at longitudinally spaced intervals opposite said burners within said drum, said plows being arranged in two staggered rows with each plow having a generally transverse front surface facing the material inlet, an inclined top surface, and an angled back surface facing the material outlet, for mixing the sand for maximum exposure to said burners while advancing the sand toward the material outlet responsive to oscillation of said drum;

an aerator pipe extending between the rows of plows for injecting air into the sand to facilitate mixing and advancement thereof, and for adding combustion air to said drum to facilitate thorough calcination of the sand by said burners in said drum;

a slidable door mounted for adjustable positioning over the material outlet in said drum;

an arcuate bottom wall secured to said drum for oscillation with said drum, said bottom wall being located beneath the material outlet for receiving calcined sand and having upper and lower surfaces;

index structure mounted on the upper surface of said bottom wall for mixing and advancing the sand;

an underlying tank of liquid coolant for cooling said bottom wall by partial immersion in the coolant, to precool the sand thereon;

inner and outer perforated arcuate plates secured to said bottom wall for receiving precooled sand therefrom responsive to oscillation of said drum, said inner plate being of relatively larger perforation than said outer plate to classify the sand; and a hopper underlying said perforated plates for receiving the classified sand.

16. A method for calcining sand, comprising the steps of:

providing a generally horizontal refractory-lined drum having burners along the upper side adapted to heat the interior of the drum, and having predetermined internal indexing structure along the lower side of the drum adapted to mix and advance sand responsive to oscillation of the drum about its longitudinal axis;

supporting the drum for partial rotation about its longitudinal axis;

feeding sand to be calcined through an inlet located in one end of said drum;

oscillating said drum over a predetermined arc centered on its longitudinal axis;

heating the interior of said drum with the burners sufficiently to incinerate any resins and binders on the sand and thereby effect thermal reclamation of the sand; and discharging the hot, calcined sand out of an outlet located in the other end of said drum.

17. The method of claim 16, further including the step of:

aerating the sand by means of an aerator pipe extending along the lower side of said drum to facilitate mixing and advancing of the sand, and for adding combustion air to facilitate thorough incineration of the resins and binders on the sand.

18. The method of claim 16, further including the step of:

controlling the rate of discharge of calcined sand by means of a slideable door adjustably secured over the outlet of said drum.

19. The method of claim 16, further including the steps of:

connecting an arcuate plate to said drum beneath the outlet for receiving the hot, calcined sand therefrom;

providing predetermined indexing structure on the upper surface of said plate for mixing and advancing sand responsive to oscillation of the plate with said drum; and immersing the lower surface of said plate in a tank of liquid coolant to effect cooling of the plate and the sand thereon.

20. The method according to claim 19, further including the steps of:

connecting a pair of inner and outer perforated plates to said cooling plate for receiving the precooled sand responsive to oscillation of said drum, said inner perforated plate being of relatively larger perforation than said outer perforated plate to classify the sand into oversized material and material of predetermined granular size; and providing a hopper beneath the inner and outer perforated plates to collect the calcined, precooled and classified sand.

* * * * *